US005883067A

United States Patent [19]

Kubo et al.

[11] Patent Number: 5,883,067

[45] Date of Patent: Mar. 16, 1999

[54] SOIL RELEASE AGENT FOR DRY CLEANING

[75] Inventors: Motonobu Kubo; Takashi Enomoto, both of Osaka, Japan

[73] Assignee: Daikin Industries, Ltd., Osaka, Japan

[21] Appl. No.: 722,519

[22] Filed: Sep. 27, 1996

Related U.S. Application Data

[63] Continuation of Ser. No. 417,850, Apr. 6, 1995, abandoned, which is a continuation of Ser. No. 193,023, Mar. 23, 1994, abandoned.

[30] Foreign Application Priority Data

Jul. 3, 1992 [JP] Japan ..... 4-176655
Jul. 2, 1993 [WO] WIPO ..... PCT/JP93/00911

[51] Int. Cl.[6] ..... C11D 3/37; D06M 3/06

[52] U.S. Cl. ..... 510/400; 510/285; 510/286; 8/142

[58] Field of Search ..... 8/142; 510/285, 510/286, 289, 400

[56] References Cited

U.S. PATENT DOCUMENTS

| | | | |
|---|---|---|---|
| 4,761,459 | 8/1988 | Matsuo et al. | 525/479 |
| 4,795,793 | 1/1989 | Amimoto et al. | 526/243 |
| 4,810,411 | 3/1989 | Del Peso et al. | 252/162 |

FOREIGN PATENT DOCUMENTS

| | | |
|---|---|---|
| 0 383310 | 8/1990 | European Pat. Off. . |
| 0408917 | 1/1991 | European Pat. Off. . |
| 61-266487 | 11/1986 | Japan . |

*Primary Examiner*—Michael Lewis
*Assistant Examiner*—Alexander G. Ghyka
*Attorney, Agent, or Firm*—Birch, Stewart, Kolasch & Birch, LLP

[57] ABSTRACT

A soil release agent for dry cleaning containing a copolymer having (A) a repeating unit derived from a polymerizable monomer having a fluorine atom; and (B) a repeating unit derived from a polymerizable monomer having a siloxane linkage and/or a polymerizable monomer (having no siloxane linkage) having a solubility parameter of 6 to 15 gives excellent soil release property using the dry cleaning.

5 Claims, 1 Drawing Sheet

SOIL RELEASE AGENT FOR DRY CLEANING

This application is a continuation of application Ser. No. 08/417,850 filed on Apr. 6, 1995, now abandoned which is a continuation of Ser. No. 08/193,023 filed on Mar. 23, 1994 now abandoned.

BACKGROUND OF THE INVENTION

1. Field of the Invention

The present invention relates to a soil release agent for dry cleaning.

2. Related Art

When a material having a fluoroalkyl group is coated on a solid substance surface, the substance exhibits high water- and oil-repellency due to a remarkably lowered surface energy. In view of this property, a polymer comprising a fluorine-containing polymerizable monomer such as a (meth)acrylate having a fluoroalkyl group is commercially available as a water- and oil-repellent for treating a textile such as clothes in the form of an aqueous dispersion or a solution in an organic solvent. The water- and oil-repellent is used, for example, for clothes such as a raincoat.

However, soil is always adhered to the clothes treated with the water- and oil-repellent, when the clothes are worn. The soil adhered to the clothes cannot be easily removed even if the clothes are washed, since a detergent is repelled at surfaces of the clothes.

When the clothes having the soil are washed in a water at home, the aqueous soil can be easily removed. But, it is known that the oily soil can be removed with difficulty higher than in the case of the clothes which is not treated with the water- and oil-repellent. Accordingly, the water- and oil repellent is not suitable for the clothes to which the soil easily adheres, such as work clothes.

In order to solve the above problem, a soil release agent (also referred to as "SR agent") has been developed and already practically used. In order to remove the oily soil described above, the surfaces of the clothes are treated so that they exhibit a hydrophilic nature together with oil repellency. Accordingly, the soil release agent is prepared by copolymerizing an oil-repellent polymerizable monomer having A fluoroalkyl group with a hydrophilic polymerizable monomer. In the clothes treated with this soil release agent, the oily soil can be easily removed from the clothes in water by household laundering.

The improvement of the soil release agent is being continued so as to enhance an initial soil release property and durability.

In the continuation of the improvement, the soil release treatment for the clothes which are subjected to the dry cleaning is hardly thought and almost no documents describing this are present. The soil release agent having excellent properties and suitable for the dry cleaning is not practically used.

SUMMARY OF THE INVENTION

An object of the present invention is to provide a soil release agent suitable for the dry cleaning having excellent properties.

The present invention provides a soil release agent for dry cleaning comprising a copolymer comprising (A) a repeating unit derived from a polymerizable monomer having a fluorine atom; and (B) a repeating unit derived from a polymerizable monomer having a siloxane linkage and/or a polymerizable monomer (having no siloxane linkage) having a solubility parameter of 6 to 15.

DETAILED DESCRIPTION OF THE INVENTION

Figure 1:
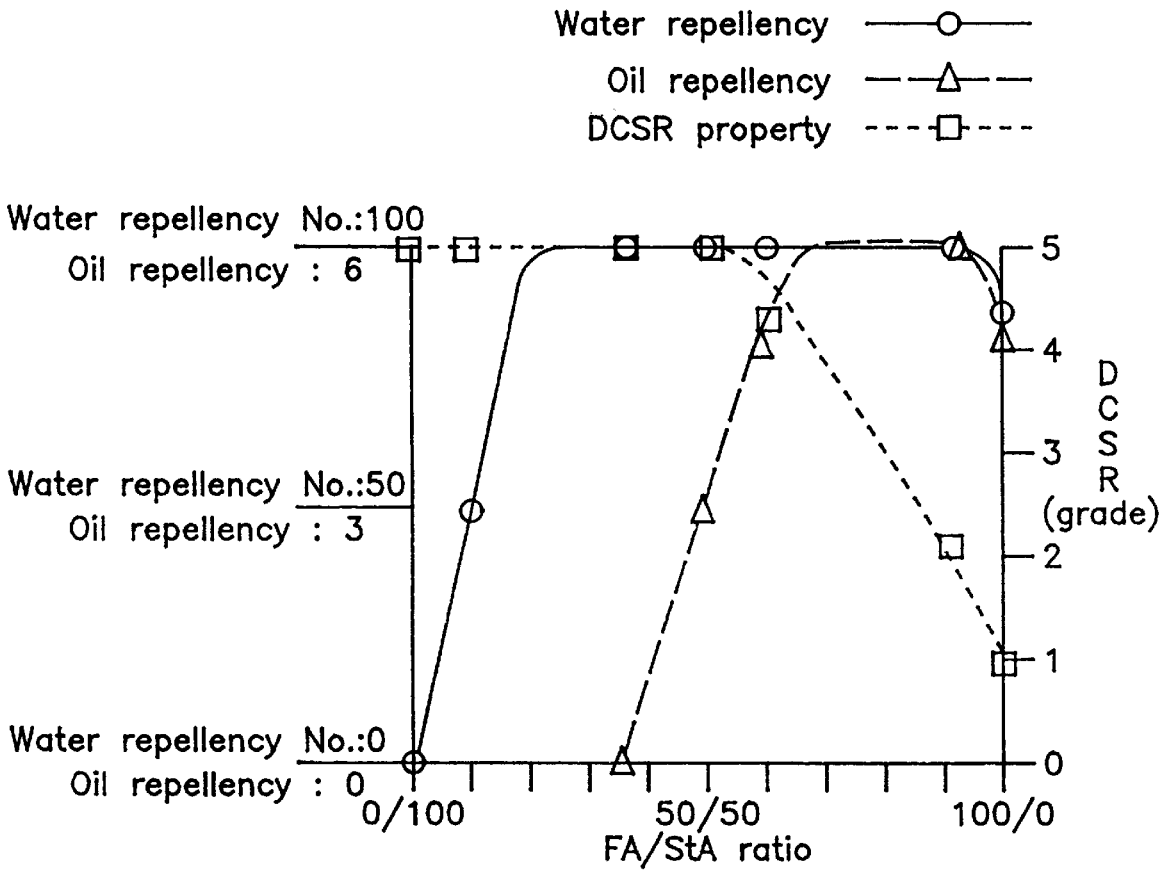
FIG. 1 is a graph showing a relationship between a ratio of monomer (a)/monomer (b), and a dry cleaning soil release property (DCSR property), water-repellency and oil-repellency.

The polymerizable monomer (A) having the fluorine atom is not limited and is preferably a (meth)acrylate having a fluoroalkyl group in which the fluoroalkyl group has 3–21 carbon atoms.

Specific examples of the polymerizable monomer (A) are as follows:

$CF_3(CF_2)_4CH_2OCOC(CH_3)=CH_2$ $CF_3(CF_2)_7(CH_2)_2OCOC(CH_3)=CH_2$ $CF_3(CF_2)_7(CH_2)_2OCOCH=CH_2$

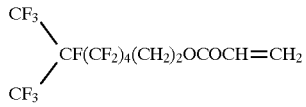

$CF_3(CF_2)_7SO_2N(C_3H_7)(CH_2)_2OCOCH=CH_2$ $CH_3(CF_2)_7(CH_2)_4OCOCH=CH_2$ $CF_3(CF_2)_7SO_2N(CH_3)(CH_2)_2OCOC(CH_3)=CH_2$ $CF_3(CF_2)_7SO_2N(C_2H_6)(CH_2)_2OCOCH=CH_2$ $CF_3(CF_2)_7CONH(CH_2)_2OCOCH=CH_2$

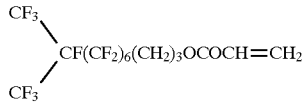

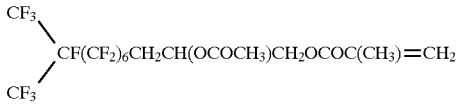

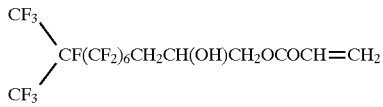

$CF_3(CF_2)_9(CH_2)_2OCOCH=CH_2$ $CF_3(CF_2)_9(CH_2)_2OCOC(CH_3)=CH_2$ $CF_3(CF_2)_9CONH(CH_2)_2OCOC(CH_3)=CH_2$

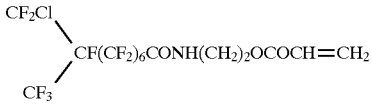

$H(CF_2)_{10}CH_2OCOCH{=}CH_2$ $CF_2Cl(CF_2)_{10}CH_2OCOC(CH_3){=}CH_2$

A specific example of the polymerizable monomer (B) having the siloxane linkage is as follows:

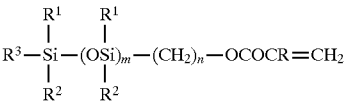

wherein R is a hydrogen atom or a methyl group, $R^1$, $R^2$ and $R^3$ each is, the same or different, a lower (for example, the number of the carbon atoms is from 1 to 4) alkyl group, m is the number of 0 to 200, and n is the number of 1 to 4.

Specific examples of the polymerizable monomer (B) having the solubility parameter of 6 to 15 and no siloxane linkage are an alkyl (meth)acrylate such as stearyl (meth) acrylate; vinyl chloride; butadiene; styrene; vinyl acetate; and vinyl stearate.

The solubility parameter (SP) used herein has a numeral value calculated according to a definition described in a document of Small (Small, Journal of Applied Chemistry, 3, 71–80, Feb. (1953)). The polymerizable monomer (B) has the solubility parameter of from 6 to 15, preferably from 7 to 12.

When the durability is required, the monomer (B) may contain a cross-linkable monomer. Specific examples of the cross-linkable monomer are a hydroxyalkyl (meth)acrylate such as 3-chloro-2-hydroxypropyl (meth)acrylate and a (meth)acrylamide such as N-methylol(meth)acrylamide. The amount of the cross-linkable monomer is usually from 0 to 10% by weight, preferably from 0.5 to 10% by weight of the monomer (B).

The copolymer may comprise 10 to 90% by weight of the monomer (A) and 90 to 10% by weight of the monomer (B), preferably 10 to 60% by weight of the monomer (A) and 90 to 40% by weight of the monomer (B), more preferably 10 to 50% by weight of the monomer (A) and 90 to 50% by weight of the monomer (B).

The copolymer having 10 to 50% by weight of a monomer (A) content has the remarkably excellent soil release property at the dry cleaning (referred to as "DCSR property" hereinafter) which is an object of the present invention (The test result of the DCSR property is grade 5 as shown in FIG. 1, and in all cases, the soil can be completely released without remaining stain). With respect to the copolymer having 10 to 60% by weight of a monomer (A) content, there is a range in which the DCSR property is slightly decreased, but in this range the copolymer has good water- and oil-repellency (As shown in FIG. 1, the copolymer having 50 to 60% by weight of the monomer (A) content has a slightly decreased DCSR property, but it has excellent oil repellency) so that the copolymer has an extended range of application.

If the monomer (A) content is larger than 90% by weight, the DCSR property is insufficient. If the monomer (B) content is larger than 90% by weight, the water repellency is insufficient.

The copolymer usually has a molecular weight of from 1,000 to 1,000,000, preferably from 5,000 to 500,000.

A copolymerization reaction can be conducted by an emulsion polymerization, a solution polymerization and the like. A surfactant and a polymerization initiator used for the emulsion polymerization are not limited. The surfactant may be an anionic, cationic or nonionic emulsifying agent, and almost all emulsifying agents can be used. The amount of the surfactant used for the emulsion polymerization is usually from 0.5 to 20 parts by weight per 100 parts by weight of the copolymer. The polymerization initiator may be various polymerization initiators such as an organic peroxide, an azo compound and a persulfate salt. In addition, ionizing radiation such as γ radiation can be used.

The soil release agent may comprise the copolymer and a medium. The medium is not limited and may be water and an organic solvent such as an alcohol, an ester and a ketone.

The soil release agent for dry cleaning according to the present invention can be applied according to a type of a treated substance. A method comprising adhering the soil release agent to a surface of the treated substance by a conventionally known coating method such the dip coating and the application coating, and then drying the soil release agent can be used. If necessary, a suitable cross-linking agent is applied together with the soil release agent so that the curing may be conducted. The soil release agent according to the present invention may be mixed with another blending polymer. Another water repellent or oil repellent, or an additive such as an insecticide, a flame retardant, an antistatic agent, a softening agent and a wrinkle resistant agent may be suitably added to the soil release agent. In the case of the dip coating, a concentration of the copolymer in a dip liquid is usually from 0.05 to 10% by weight. In the case of the application coating, a concentration of the copolymer in a coating liquid is usually from 0.1 to 5% by weight.

A textile which can be treated with the soil release agent for dry cleaning according to the present invention is not limited and may be various textiles. Specific examples of the textile are an animal - or vegetable-origin natural fiber such as cotton, hemp, wool and silk: a synthetic fiber such as a polyamide, polyester, polyvinylalcohol, polyacrylonitrile, polyvinyl chloride and polypropyrene; a semisynthetic fiber such as rayon and acetate: an inorganic fiber such as a glass fiber, carbon fiber and an asbestos fiber: and a mixture of these fibers. The textile may be in the form of a fiber, a yarn, a fabric and the like. Specific examples of the clothes treated with the soil release agent for dry cleaning according to the present invention includes sportswear such as skiing wear, tennis wear, golf wear and rider wear.

PREFERRED EMBODIMENT OF THE INVENTION

The present invention will be illustrated by the following Examples which do not limit the present invention.

The water repellency and the oil repellency in Examples are shown according to the following criteria. The water repellency is expressed by the water repellency No. (cf. the following Table 1) determined by the spray method according to JIS (Japanese Industrial Standard) L-1092. The oil repellency is determined by dropping several drops (diameter: about 4 mm) of a test solution shown in Table 2 on two positions of a surface of a test cloth and observing the penetration state of the drops after 30 seconds (cf. AATCC-TM118-1966). The oil repellency is a maximum value of the oil repellency given by the test solution which does not penetrate.

TABLE 1

| Water repellency No. | State |
|---|---|
| 100 | No wet on the surface |
| 90 | Slight wet on the surface |
| 80 | Partial wet on the surface |
| 70 | Wet on the surface |
| 50 | We over the whole surface |
| 0 | Complete wet on the front and back surfaces |

TABLE 2

| Oil repellency | Test solution | Surface tension (dyne/cm, 25° C.) |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | n-Hexadecane/Nujol (35/65 by weight) | 29.6 |
| 1 | Nujol | 31.2 |
| 0 | Inferior to 1 | |

The superscript "+" to the water repellency No. and the oil repellency represents that the result is slightly better than said water repellency No. and said oil repellency, respectively.

The test for determining the soil release property at dry cleaning (DCSR property) is conducted as follows. A test cloth is spread on a piece of blotting paper horizontally spread and then five drops of a dirty motor oil (SAE20W-40, drained after the feed into an engine of a compact car and the running for 4,000 km) are dropped on the test cloth. A polyethylene sheet is positioned on the test cloth and a weight of 2 kg in weight is positioned on the polyethylene sheet. After 60 seconds, the weight and the polyethylene sheet are removed. An excess oil is wiped off and the test cloth is kept standing at a room temperature for 24 hours. The test cloth and a ballast cloth together having a total weight of 450 g are charged into a dry cleaning tester, the dry cleaning is conducted at a room temperature for 5 minutes using 3.78 L of Perclene, and the test cloth is air-dried. The state of the remaining stain of the dried test cloth is compared with a standard photograph plate so that the state of the remaining stain is expressed by the corresponding determined grade (cf. Table 3).

The standard photograph plate is one according to AATCC Test Method 130-1970

TABLE 3

| Determined grade | Criteria |
|---|---|
| 1.0 | Stain remarkably remains |
| 2.0 | Stain considerably remains |
| 3.0 | Stain slightly remains |
| 4.0 | Stain is not noticeable |
| 5.0 | Stain does not remain |

The superscript "+" to the grade represents that the result is slightly better than said grade.

The test for the soil release property at household laundering (HLSR property) is conducted as follows. In the same manner as in the test for the DCSR property, the dirty motor oil is adhered to the test cloth. The test cloth and a ballast cloth together having a total weight of 1 kg are charged into a household full automatic washing machine, and the washing is conducted for 5 minutes using 30 L of water and 25 g of a detergent (trade name: Hi-top manufactured by Lion Corp.). After the rinsing by water is conducted for 3 minutes and the dewatering is conducted for 3 minutes, the test cloth is air-dried. In the same manner as in the test for the DCSR property, the remaining stain is evaluated.

EXAMPLE 1

A ternary copolymer of an acrylate having a fluoroalkyl group/stearyl acrylate/N-methylolacrylamide prepared by a typical emulsion polymerization is illustrated in this Example.

$C_nF_{2n+1}CH_2CH_2COOCH{=}CH_2$ (a mixture of compounds in which n is 6, 8, 10,12 and 14; an average of n is 8.6) (50 g), stearyl acrylate (25.5 g), N-methylolacrylamide (1.5 g), pure water (320 g), acetone (30 g), acetic acid (0.3 g), polyoxyethylenealkyl phenyl ether (6 g) and alkyltrimethylammonium chloride (10 g) were charged in a 500 cc flask and emulsified by an ultrasonic wave at 50° C. for 15 minutes with stirring. Azobisisobutylamidine dihydrochloride (0.75 g) was added and the reaction was conducted for 5 hours. A resultant emulsion contained 20% by weight of a copolymer. The copolymer had a composition shown in Table 4.

Then the emulsion was diluted with pure water to 1.0% by weight of a copolymer concentration. A cotton fabric was dipped in the diluted emulsion and squeezed by a mangle to have a wet pickup of 60%. The cotton fabric was dried at 80° C. for 3 minutes and then thermally treated at 150° C. for 3 minutes. The water repellency, the oil repellency and the soil release property of the cotton fabric were evaluated. The results are shown in Table 4.

EXAMPLES 2 TO 11 AND COMPARATIVE EXAMPLES 1 AND 2

Using various monomers, the same manner as in Example 1 was repeated. In the case of a gaseous monomer, an autoclave was used instead of the flask to conduct the polymerization.

The results are shown in Table 4. Based on these results, the relationship between the DCSR property and the water- and oil-repellency is shown in FIG. 1.

TABLE 4

| Example No. | Composition of copolymer (weight ratio) | Water repellency/ oil repellency | Soil release property at dry cleaning | Soil release property at household laundering |
|---|---|---|---|---|
| 1 | FA/StA/NMAM = 35/63/2 | $100^+/0$ | 5 | 1 |
| 2 | FA/StA/NMAM = 65/33/2 | $100^+/7$ | 4 | 1 |
| 3 | FA/StA/VCI/NMAM = 65/5/28/2 | $100^+/6$ | 4 | 1 |
| 4 | FA/VCI/NMAM = 65/33/2 | $100^+/7$ | 4 | 1 |
| 5 | FA/butadiene/NMAM = 65/33/2 | $100^+/7$ | 4 | 1 |
| 6 | FA/SiM/NMAM = 65/33/2 | $100^+/5$ | 4 | 1 |
| 7 | FA/StA = 35/65 | 100/0 | 5 | |
| 8 | FA/StA = 90/10 | 100/6 | $2^+$ | 1 |

TABLE 4-continued

| Example No. | Composition of copolymer (weight ratio) | Water repellency/ oil repellency | Soil release property at dry cleaning | Soil release property at household laundering |
|---|---|---|---|---|
| 9 | FA/StA = 10/90 | 50/0 | 5 | 1 |
| 10 | FA/StA = 60/40 | $100^+/5$ | $4^+$ | 1 |
| 11 | FA/StA = 50/50 | $100^+/3$ | 5 | 1 |
| Comp. 1 | FA = 100 | $80^+/5$ | 1 | 1 |
| Comp. 2 | StA = 100 | 0/0 | 5 | 1 |

FA:

$$CH_2{=}CH{-}\underset{\underset{O}{\|}}{C}{-}O{-}CH_2CH_2C_nF_{2n+1}$$

a mixture of compounds in which n is 6, 8, 10, 12 and 14 (the average of n is 8.6)

StA: Stearyl acrylate

NMAM: N-methylolacrylamide

VCl: Vinyl chloride

SiM:

$$CH_2{=}C(CH_3){-}\underset{\underset{O}{\|}}{C}{-}O{-}(CH_2)_3{-}\overset{\overset{CH_3}{|}}{\underset{\underset{CH_3}{|}}{(Si}}O)_{65}{-}\overset{\overset{CH_3}{|}}{\underset{\underset{CH_3}{|}}{Si}}{-}CH_3$$

The soil release agent for dry cleaning according to the present invention exhibits the effect (namely, the soil release property) only when the dry cleaning is conducted. It is not expected that the soil release agent according to the present invention has the effect when the household laundering, namely the washing in water is conducted. From this point of view, the soil release agent according to the present invention is different from a conventionally known soil release agent (SR agent).

When the soil release agent for dry cleaning according to the present invention is used, the soil release property using the dry cleaning is excellent.

When the soil release agent for dry cleaning according to the present invention is used for clothes and the dry cleaning of the clothes is conducted, the soil is surprisingly easily removed from the clothes to the degree that the dry cleaning is remarkably superior the washing in water.

What is claimed is:

1. A method for providing dry cleaning soil release properties to a textile, which comprises adhering a soil release agent for dry cleaning to the textile by a coating method, and then drying the soil release agent, wherein the soil release agent for dry cleaning comprises a copolymer formed by reacting under polymerization conditions:

(A) a polymerizable monomer having a fluorine atom which is present in an amount of from 10 to 60% by weight; and (B) stearyl acrylate, said unit (B) being present in an amount of from 40 to 50% by weight.

2. The method according to claim 1, wherein (A) the polymerizable monomer having the fluorine atom is a (meth) acrylate having a fluoroalkyl group in which the fluoroalkyl group has 3–21 carbon atoms.

3. The method according to claim 1, wherein a cross-linking agent is applied together with the soil release agent.

4. The method according to claim 2, wherein the polymerizable monomer derived repeating unit (A) is derived from a monomer selected from the group consisting of:

$CF_3(CF_2)_4CH_2OCOC(CH_3){=}CH_2$, $CF_3(CF_2)_7(CH_2)_2OCOC(CH_3){=}CH_2$, $CF_3(CF_2)_7(CH_2)_2OCOCH{=}CH_2$, $(CF_3)_2CF(CF_2)_4(CH_2)_2OCOCH{=}CH_2$, $CF_3(CF_2)_7SO_2N(C_3H_7)(CH_2)_2OCOCH{=}CH_2$, $CH_3(CF_2)_7(CH_2)_4OCOCH{=}CH_2$, $CF_3(CF_2)_7SO_2N(CH_3)(CH_2)_2OCOC(CH_3){=}CH_2$, $CF_3(CF_2)_7SO_2N(C_2H_6)(CH_2)_2OCOCH{=}CH_2$, $CF_3(CF_2)_7CONH(CH_2)_2OCOCH{=}CH_2$, $(CF_3)_2CF(CF_2)_6(CH_2)_3OCOCH{=}CH_2$, $(CF_3)_2CF(CF_2)_6CH_2CH(OCOCH_3)CH_2OCOC(CH_3){=}CH_2$, $(CF_3)_2CF(CF_2)_6CH_2CH(OH)CH_2OCOCH{=}CH_2$, $CF_3(CF_2)_9(CH_2)_2OCOCH{=}CH_2$, $CF_3(CF_2)_9(CH_2)_2OCOC(CH_3){=}CH_2$, $CF_3(CF_2)_9CONH(CH_2)_2OCOC(CH_3){=}CH_2$, $(CF_2Cl)(CF_3)CF(CF_2)_6CONH(CH_2)_2OCOCH{=}CH_2$, $H(CF_2)_{10}CH_2OCOCH{=}CH_2$, and $CF_2Cl(CF_2)_{10}CH_2OCOC(CH_3){=}CH_2$.

5. The method according to claim 1, wherein the copolymer has a molecular weight of from 5,000 to 500,000.

* * * * *